US011065748B2

(12) United States Patent
Hung et al.

(10) Patent No.: US 11,065,748 B2
(45) Date of Patent: Jul. 20, 2021

(54) SAFETY MEMBER AND MUZZLE OF NAIL GUN HAVING THE SAME

(71) Applicant: Basso Industry Corp., Taichung (TW)

(72) Inventors: Liang-Chi Hung, Taichung (TW); Li-Hsin Chang, Taichung (TW); Sheng-Man Wang, Taichung (TW)

(73) Assignee: Basso Industry Corp., Taichung (TW)

( * ) Notice: Subject to any disclaimer, the term of this patent is extended or adjusted under 35 U.S.C. 154(b) by 171 days.

(21) Appl. No.: 16/101,796

(22) Filed: Aug. 13, 2018

(65) Prior Publication Data

US 2019/0054604 A1 Feb. 21, 2019

(30) Foreign Application Priority Data

Aug. 16, 2017 (TW) ..... 106212093

(51) Int. Cl.
*B25C 1/00* (2006.01)
*B25C 7/00* (2006.01)

(52) U.S. Cl.
CPC ..... *B25C 1/008* (2013.01); *B25C 7/00* (2013.01)

(58) Field of Classification Search
CPC ..... B25C 1/008; B25C 7/00; B25C 1/06
USPC ..... 227/8
See application file for complete search history.

(56) References Cited

U.S. PATENT DOCUMENTS 5,593,079 A * 1/1997 Mukoyama ..... B25C 1/008 227/120
6,024,269 A * 2/2000 Ho ..... B25C 1/042 227/130
6,966,477 B1 * 11/2005 Chien-Kuo ..... B25C 1/005 227/120
7,182,236 B1 * 2/2007 Wen ..... B25C 1/005 227/120
7,331,685 B2 * 2/2008 Shen ..... B25C 7/00 362/119
8,052,021 B2 * 11/2011 Wu ..... B25C 1/008 227/120
2006/0091175 A1 * 5/2006 Hung ..... B25C 1/005 227/8
2010/0127035 A1 * 5/2010 Wu ..... B25C 1/001 227/125
2011/0084111 A1 * 4/2011 Liang ..... B25C 1/008 227/125
2018/0126531 A1 * 5/2018 Pomeroy ..... B25C 1/04

FOREIGN PATENT DOCUMENTS

JP 2002283253 A 10/2002

* cited by examiner

*Primary Examiner* — Anna K Kinsaul
*Assistant Examiner* — Himchan Song
(74) *Attorney, Agent, or Firm* — MLO, a professional corp.

(57) ABSTRACT

A safety member is adapted for use in a muzzle of a nail gun. The muzzle defines a nail passage that is for passage of a nail, and a gap that spatially communicates with the nail passage. The safety member is slidable in a nail striking direction of the nail, and includes a slider adapted to be disposed in the gap, and having a flat surface, a platform and an abutment end. The flat surface is adapted to face the plate member. The platform protrudes from the flat surface toward the plate member and cooperates with the plate member to define a nail ejection opening therebetween. The abutment end extends from the platform and extends beyond the nail ejection opening for contact with an object to be fastened.

7 Claims, 4 Drawing Sheets

SAFETY MEMBER AND MUZZLE OF NAIL GUN HAVING THE SAME

CROSS-REFERENCE TO RELATED APPLICATION

This application claims priority of Taiwanese Patent Application No. 106212093, filed on Aug. 16, 2017.

FIELD

The disclosure relates to a safety member, and more particularly to a safety member of a muzzle of a nail gun.

BACKGROUND

Japanese Patent Application Publication Number JP2002-283253A discloses a muzzle of a nail gun including a barrel member, a plate member that is fixedly mounted on the barrel member, and a safety member that is slidable between the barrel member and the plate member. A grooved portion of the safety member and the plate member cooperatively define a passage for a nail to pass therethrough. As such, when the safety member is pushed by an object, the safety member would slide between the barrel member and the plate member to switch the nail gun to a nail striking state, allowing the nail to be ejected through the passage.

However, the type of muzzle, which can incorporate the barrel member, the plate member and the safety member, is usually designed to maintain a large spacing between the barrel member and the plate member in order to successfully fit the safety member therebetween, which in turn leaves a bigger gap between the grooved portion of the safety member and the plate member that is too large for the nail to move along a straight path to strike the object effectively.

SUMMARY

Therefore, an object of the disclosure is to provide a safety member that can alleviate the drawback of the prior art.

Accordingly, the safety member is adapted for use in a muzzle of a nail gun and is operable to allow the nail gun to switch to a nail striking state. The muzzle of the nail gun includes a plate member and a barrel member. The plate member and the barrel member cooperatively define a nail passage which is for passage of a nail, and a gap which spatially communicates with the nail passage. The safety member is slidable in a nail striking direction of the nail. The safety member includes a slider adapted to be disposed in the gap, and having a flat surface, a platform and an abutment end. The flat surface is adapted to face the plate member. The platform protrudes from the flat surface toward the plate member and cooperates with the plate member to define a nail ejection opening therebetween. The abutment end extends from the platform and extends beyond the nail ejection opening for contact with an object to be fastened.

Another object of the disclosure is to provide a muzzle of a nail gun, which is operable to actuate a nail striking pin of the nail gun to switch to a nail striking state to strike a nail.

Accordingly, the muzzle of a nail gun includes a plate member, a barrel member, and a safety member. The barrel member cooperates with the plate member to define a nail passage which is adapted for passage of the nail. The safety member includes a slider that is disposed between the plate member and the barrel member and that is slidable in a nail striking direction of the nail. The slider has a flat surface facing the plate member, and a platform protruding from the flat surface toward the plate member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
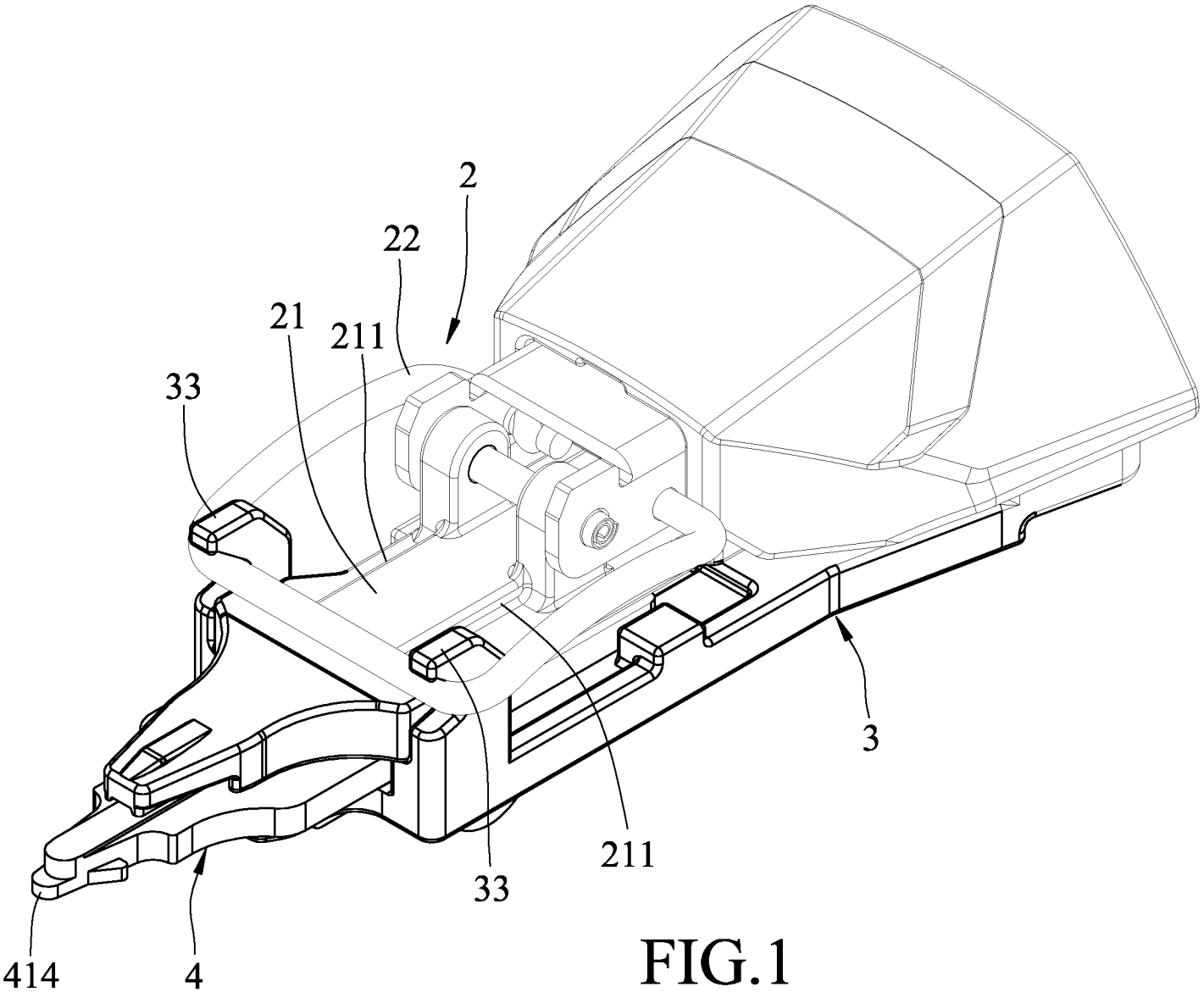
FIG. 1 is a perspective view of an embodiment of a muzzle of a nail gun according to the disclosure.
Figure 3:
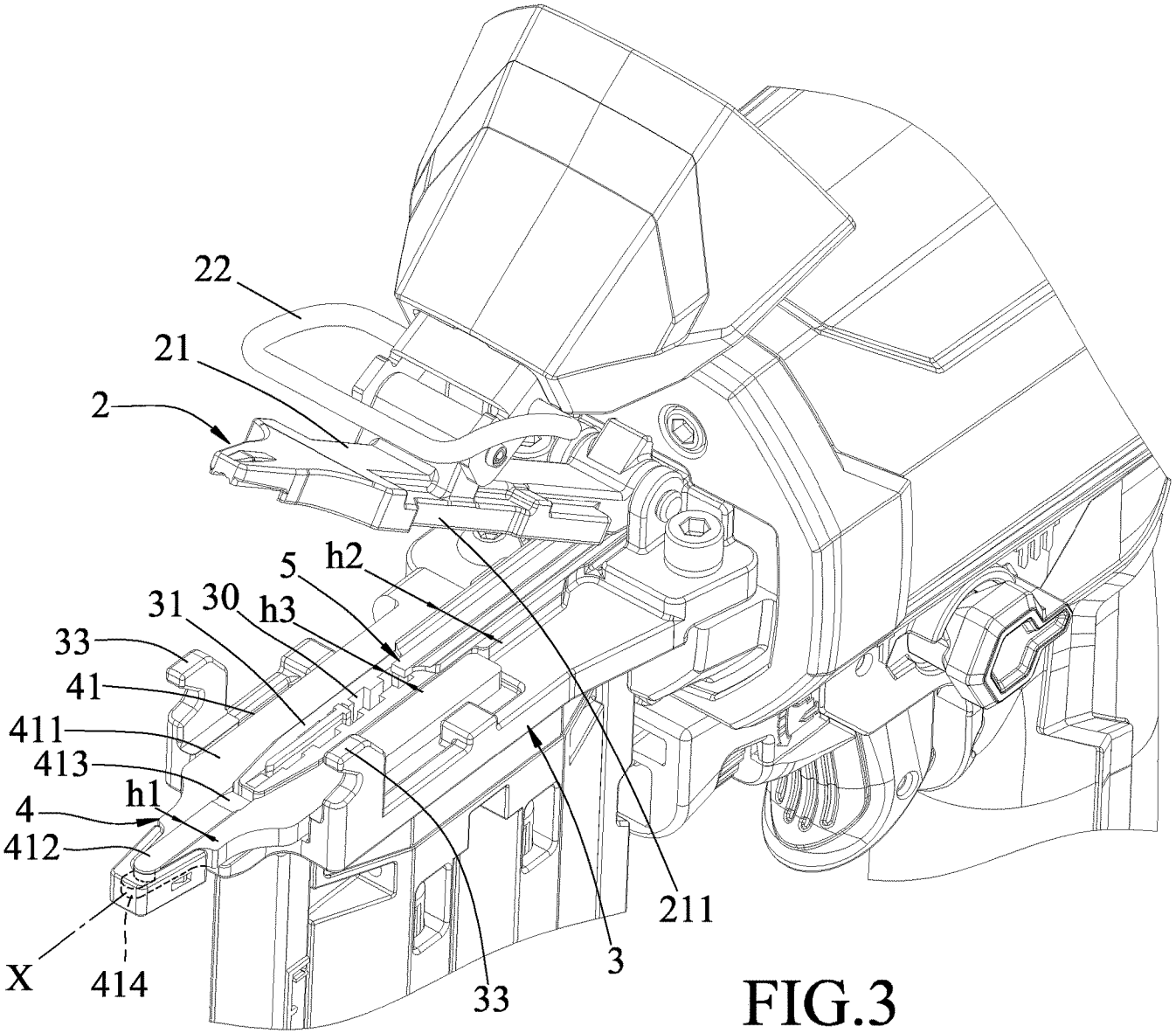
FIG. 3 is another perspective view of the embodiment, illustrating a plate member being pivoted relative to a barrel member and the safety member being disposed therebetween.

Referring to FIGS. 1 and 3, an embodiment of a muzzle of a nail gun according to the disclosure is operable to actuate a nail striking pin 5 of the nail gun to switch to a nail striking state to strike a nail 6 in a nail striking direction (X). The muzzle includes a plate member 2, a barrel member 3, and a safety member 4.

The plate member 2 includes a plate body 21 and a lock piece 22 that is pivotally connected to the plate body 21. The plate body 21 has two notches 211 respectively formed in opposite sides thereof.

Figure 4:
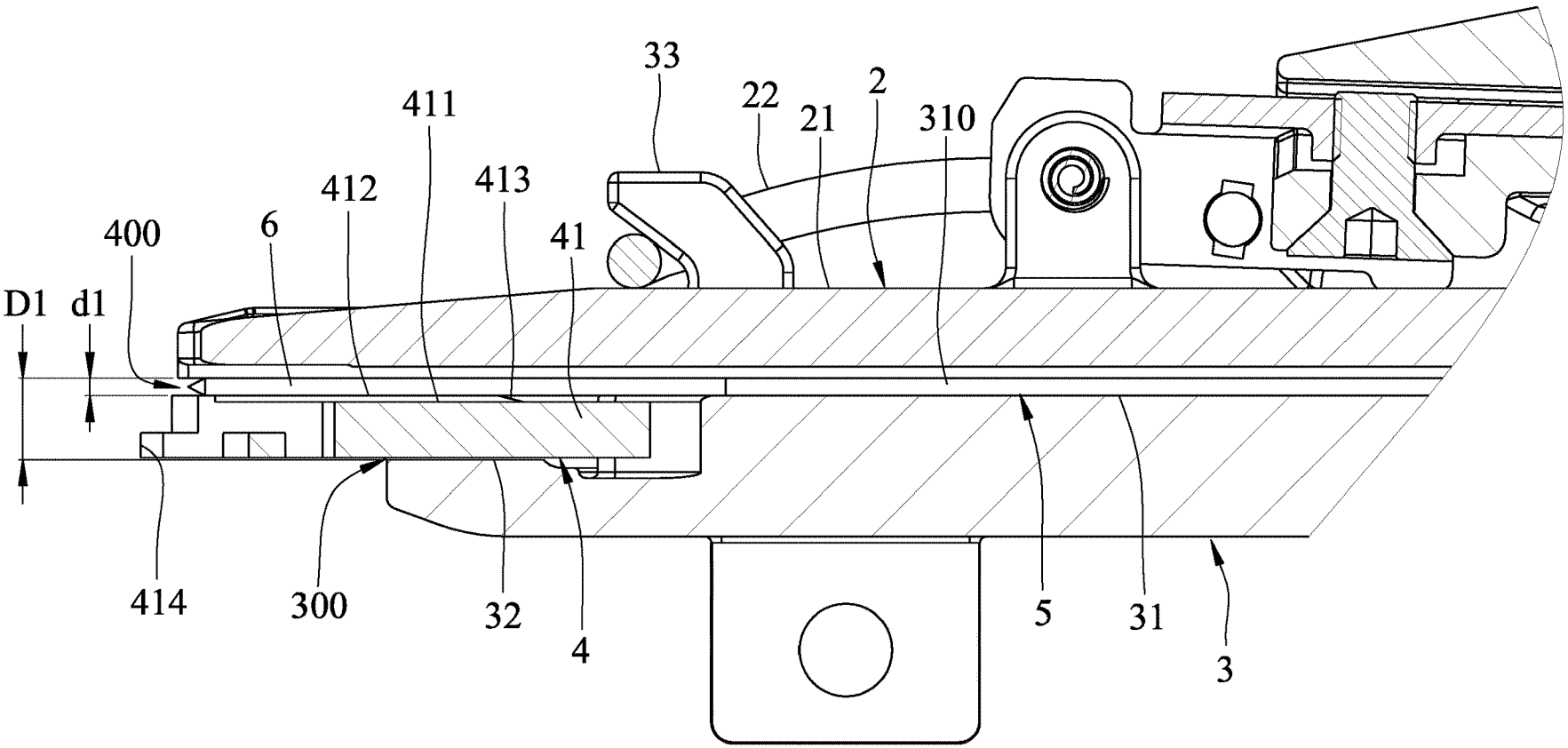
FIG. 4 is a fragmentary sectional view of the embodiment.

Referring to FIGS. 3 and 4, the barrel member 3 has a nail receiving surface 31, a support surface 32 and two hook portions 33. The nail receiving surface 31 is formed with a nail receiving opening 30, is proximate to the plate member 2, and cooperates with the plate member 2 to define a nail passage 310 that is adapted for passage of the nail 6 which is advanced from a cartridge (not shown) through the nail receiving opening 30. The support surface 32 is further away from the plate member 2 than the nail receiving surface 31, and cooperates with the plate member 2 to define a gap 300 that spatially communicates with the nail passage 310. The hook portions 33 are formed on the support surface 32, respectively extend through the notches 211 of the plate body 21, and cooperatively and removably hook the lock piece 22 of the plate member 2 so as to secure the plate member 2 with respect to the barrel member 3.

Figure 2:
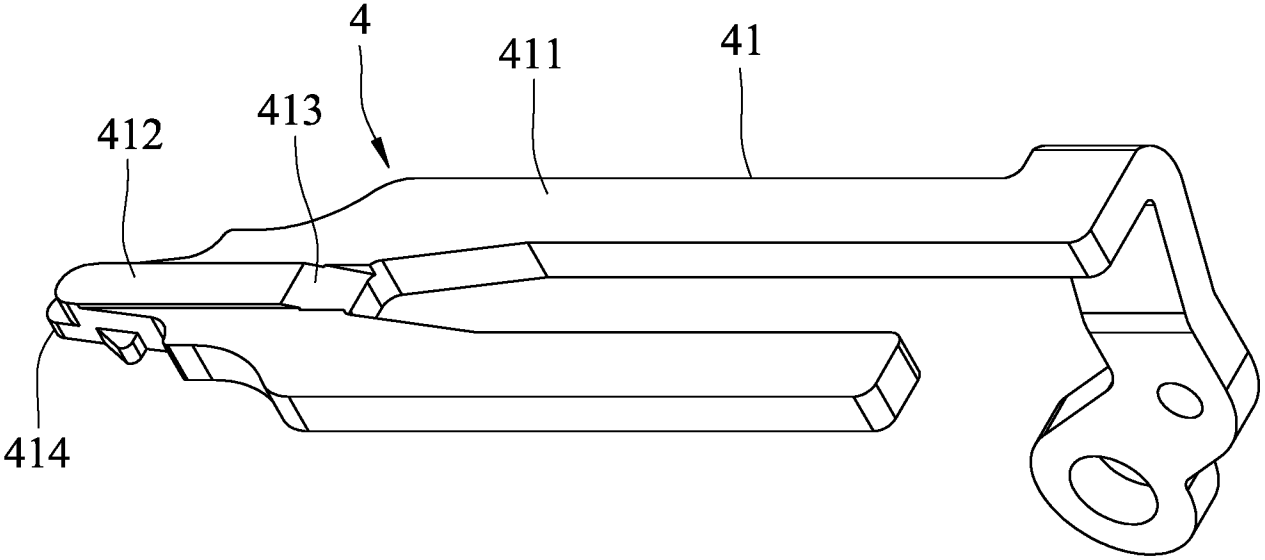
FIG. 2 is a perspective view of the safety member of the embodiment.

In this embodiment, as shown in FIGS. 2 to 4, the safety member 4 includes a slider 41 that is adapted to be disposed in the gap 300 between the plate member 2 and support surface 32 of the barrel member 3, and that is slidable in the nail striking direction (X) of the nail 6, which is also a lengthwise direction of the barrel member 3. The slider 41 has a flat surface 411 that faces and is spaced apart from the plate member 2, a platform 412 that protrudes from the flat surface 411 toward the plate member 2, an inclined surface 413 that has an end connected to the platform 412 and an opposite end connected to the flat surface 411, and an abutment end 414 that extends from the platform 412. The inclined surface 413 is adapted for guiding movement of the nail 6 received in the nail passage 310 during a nail striking operation. The platform 412 extends in the nail striking direction (X), and cooperates with the plate member 2 to define a nail ejection opening 400 therebetween (see FIG. 4). The abutment end 414 extends beyond the ejection opening 400 in the nail striking direction (X) for contact with an object (not shown) to be fastened.

It should be noted that, as shown in FIG. 3, the platform 412 of the slider 41 has a maximum width (h1) that is smaller than a maximum width (h2) of the nail striking pin 5, and that is greater than a maximum width (h3) of the nail receiving opening 30 with respect to a direction perpendicular to the nail striking direction (X). The abovementioned width configurations ensure that the nail 6 moves smoothly over the platform 412 in the nail striking direction (X) during a nail striking operation.

In addition, the slider 41 has a thickness smaller than a thickness (D1) of the gap 300 in order to be slide between the plate member 2 and the support surface 32 of the barrel member 3 smoothly. Moreover, since the platform 412 is closer to the plate member 2 than the flat surface 411, a thickness (d1) of the nail ejection opening 400 can be reduced in comparison with the passage of the abovementioned conventional muzzle of the nail gun. Also, the platform 412 is configured to be flush with the nail receiving surface 31 of the barrel member 3, so that a thickness of the nail passage 310 and a distance between the plate member 412 and the plate member 2 (i.e., the thickness (d1) of the nail ejection opening 400) are the same.

As such, when the abutment end 414 of the safety member 4 is pushed rearward by the object, or is pushed forward by a withheld trigger (not shown), the safety member 4 would be sliding in the lengthwise direction of the barrel member 3 within the gap 300. When the safety member 4 triggers the nail gun to switch to the nail striking state, the nail 6 would then be ejected from the nail ejection opening 400.

While it is known that the plate member 2 is secured with respect to the barrel member 3 via the hooking between lock piece 22 and the hook portions 33 of the barrel member 3, pressure generated by the abovementioned hooking mechanism and the malleability of different types of metallic material may cause deflection of the flat surface 411 of the safety member 4. Fortunately, in this embodiment, the thickness (d1) the nail ejection opening 400 is defined between the plate member 2 and the platform 412, which is unaffected by the pressure generated by the hooking mechanism since the platform 412 is configured not to be pressed by the plate member 2, alleviating inconsistency of the thickness (d1) of the nail ejection opening 400 due to deflection of the flat surface 411.

Overall, by utilizing the platform 412 on the slider 4 to further minimize the gap 300, the thickness (d1) of the nail ejection opening 400 and the distance between the plate member 2 and the nail receiving surface 31 would remain consistent throughout.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A muzzle of a nail gun, the nail gun being operable to actuate a nail striking pin of the nail gun to switch to a nail striking state to strike a nail, said muzzle comprising:

a plate member;

a barrel member cooperating with a bottom surface of said plate member to define a nail passage which is adapted for passage of the nail; and a safety member including a slider that is disposed between said plate member and said barrel member and that is slidable in a nail striking direction of the nail, said slider having a flat surface facing said bottom surface of said plate member, and a platform protruding from said flat surface toward said bottom surface of said plate member;

wherein said platform and said plate member cooperatively define a nail ejection opening therebetween; and wherein said slider of said safety member further has an abutment end that extends from said platform and that extends beyond said nail ejection opening for contact with an object to be fastened.

2. The muzzle as claimed in claim 1, wherein said platform of said slider of said safety member extends in the nail striking direction.

3. The muzzle as claimed in claim 1, wherein said barrel member has:

a nail receiving surface which is formed with a nail receiving opening, which is proximate to said plate member, and which cooperates with said plate member to define said nail passage, and a support surface which is further away from said plate member than said nail receiving surface, and which cooperates with said plate member to define a gap adapted for said slider of said safety member to slide therein.

4. The muzzle as claimed in claim 3, wherein a maximum width of said platform is smaller than a maximum width of the nail striking pin and is greater than a maximum width of said nail receiving opening with respect to a direction perpendicular to the nail striking direction, so as to ensure the nail to move smoothly over said platform in the nail striking direction during a nail striking operation.

5. The muzzle as claimed in claim 1, wherein said slider of said safety member further has an inclined surface that has an end connected to said platform and an opposite end connected to said flat surface, and that is adapted for guiding movement of the nail received in said nail passage during a nail striking operation.

6. The muzzle as claimed in claim 1, wherein said plate member includes a plate body, and a lock piece that is pivotally connected to said plate body and that removably engages said barrel member for maintaining relative position between said plate member with said barrel member.

7. The muzzle as claimed in claim 6, wherein said plate body of said plate member has two notches respectively formed in opposite sides thereof, said barrel member having two hook portions that respectively extend through said notches and that cooperatively and removably hook said lock piece of said plate member so as to secure said plate member with respect to said barrel member.

* * * * *